US008192342B2

(12) United States Patent
Träger et al.

(10) Patent No.: US 8,192,342 B2
(45) Date of Patent: Jun. 5, 2012

(54) SEPARATOR HAVING A LIQUID OUTLET INCLUDING A THROTTLING DEVICE

(75) Inventors: Kim Träger, Kalundborg (DK); Herbert Kunz, Oelde (DE)

(73) Assignee: Westfalia Separator AG, Oelde (DE)

( * ) Notice: Subject to any disclaimer, the term of this patent is extended or adjusted under 35 U.S.C. 154(b) by 600 days.

(21) Appl. No.: 11/922,495

(22) PCT Filed: May 11, 2006

(86) PCT No.: PCT/EP2006/004414
§ 371 (c)(1),
(2), (4) Date: Aug. 14, 2009

(87) PCT Pub. No.: WO2007/131515
PCT Pub. Date: Nov. 22, 2007

(65) Prior Publication Data

US 2009/0298666 A1 Dec. 3, 2009

(51) Int. Cl.

| | |
|---|---|
| ***B04B 1/14*** | (2006.01) |
| ***B04B 11/02*** | (2006.01) |
| ***B04B 11/08*** | (2006.01) |
| *B04B 1/08* | (2006.01) |

(52) U.S. Cl. ..... 494/1; 494/10; 494/37; 494/57; 494/70

(58) Field of Classification Search ..... 494/1–3, 494/10, 37, 53, 54, 56, 57, 68–73; 210/380.1, 210/380.3
See application file for complete search history.

(56) References Cited

U.S. PATENT DOCUMENTS

| | | | | |
|---|---|---|---|---|
| 3,179,334 | A * | 4/1965 | Sharples | 494/4 |
| 4,042,172 | A | 8/1977 | Nozdrovsky | |
| 4,525,155 | A | 6/1985 | Nilsson | |
| 5,217,428 | A | 6/1993 | Schip et al. | |
| 5,593,377 | A | 1/1997 | Figgener et al. | |
| 5,643,169 | A | 7/1997 | Leung et al. | |
| 5,695,442 | A | 12/1997 | Leung et al. | |
| 5,788,622 | A * | 8/1998 | Borgstrom et al. | 494/57 |
| 5,885,202 | A | 3/1999 | Ostkamp | |
| 7,056,273 | B2 | 6/2006 | Ostkamp et al. | |
| 7,326,169 | B2 | 2/2008 | Brüning et al. | |
| 2005/0164861 | A1 | 7/2005 | Bruning et al. | |
| 2009/0298666 | A1 * | 12/2009 | Trager et al. | 494/10 |
| 2010/0184579 | A1 * | 7/2010 | Trager | 494/56 |

FOREIGN PATENT DOCUMENTS

| | | |
|---|---|---|
| CA | 1 180 195 | 1/1985 |
| DE | 1 220 012 | 6/1966 |
| DE | 26 17 692 A1 | 11/1977 |
| DE | 27 07 111 A1 | 8/1978 |

(Continued)

*Primary Examiner* — Charles E Cooley
(74) *Attorney, Agent, or Firm* — Barnes & Thornburg LLP

(57) ABSTRACT

A separator having a conical separator drum mounted rotatably at only one of its axial ends and having a vertical axis of rotation. The drum includes a rotary spindle for driving the separator drum. The separator includes an inflow pipe for a product to be processed and at least two liquid outlets. The first liquid outlet is for a lighter phase and the second liquid outlet is for a heavier phase. The first liquid outlet includes a stripping disk. Further included is a solids discharge port and a separation plate stack in the separator drum. The second liquid outlet is followed outside the drum by a settable throttle device having an annular disk for displacing a liquid radius of the heavier phase by a throttling in an outflow cross section for the heavier phase.

17 Claims, 9 Drawing Sheets

FOREIGN PATENT DOCUMENTS

| | | | | |
|---|---|---|---|---|
| DE | 30 14 315 | | | 10/1981 |
| DE | 3806742 | A1 | * | 10/1988 |
| DE | 37 28 901 | C1 | | 11/1988 |
| DE | 38 22 983 | A1 | | 1/1990 |
| DE | 39 21 327 | A1 | | 1/1991 |
| DE | 41 32 029 | A1 | | 4/1993 |
| DE | 195 00 600 | C1 | | 2/1996 |
| DE | 696 20 500 | | | 11/2002 |
| DE | 102 03 652 | A1 | | 8/2003 |
| DE | 102 09 925 | A1 | | 9/2003 |
| DE | 10 223 802 | A1 | | 12/2003 |
| EP | 0 123 491 | A2 | | 10/1984 |
| EP | 0 702 599 | B1 | | 3/1996 |
| EP | 1 044 723 | A1 | | 10/2000 |
| GB | 1 569 520 | | | 6/1980 |
| WO | WO 86/01436 | | | 3/1986 |
| WO | WO 96/34693 | | | 11/1996 |
| WO | WO 02/05966 | A2 | | 1/2002 |
| WO | WO 02/062483 | A1 | | 8/2002 |
| WO | WO 2006/096113 | A1 | | 9/2006 |

* cited by examiner

| NOZZLE SEPARATOR ODB 260 EXAMPLE | | | |
|---|---|---|---|
| STRIPPING DISK (LIGHT LIQUID WEIR RADIUS $r_{LP}$) | | | |
| DIAMETER | 260,0 mm | RADIUS | 130,0 mm |
| MINIMUM DIAMETER | 190,0 mm | MINIMUM WEIR RADIUS | 95,0 mm |
| | | | |
| THROTTLE DEVICE (HEAVY LIQUID WEIR RADIUS $r_{HP}$) | | | |
| MAXIMUM DIAMETER | 340,0 MM | MINIMUM WEIR RADIUS | 170,0 mm |
| MINIMUM DIAMETER | | | |
| SEPARATION PLATE (SEPARATION LINE RADIUS $r_E$) | | | |
| MAXIMUM SEPARATION LINE DIAMETER | 820,0 mm | MAXIMUM SEPARATION LINE RADIUS | 410,0 mm |
| MINIMUM SEPARATION LINE DIAMETER | 620,0 mm | MINIMUM SEPARATION LINE RADIUS | 310,0 mm |

*FIG. 5a'*

| DEFINITIONS | |
|---|---|
| $P_{LP}$ := LIGHT LIQUID DENSITY | $r_{LP}$ := WEIR RADIUS, LIGHT LIQUID |
| $P_{HP}$ := HEAVY LIQUID DENSITY | $r_{HP}$ := WEIR RADIUS, HEAVY LIQUID |
| $\Delta P_{SS}$ := "EXTRA" PRESSURE LOSS ACROSS STRIPPING DISK | $r_E$ := SEPARATION LINE RADIUS (SEPARATION RADIUS BETWEEN THE TWO LIQUIDS) |
| FL := LIQUID | N := DRUM ROTATIONAL SPEED |
| $r^*_{LP}$ := CORRECTED LIGHT FL WEIR RADIUS DUE TO $\Delta$PSS | |

*FIG. 5a"*

CHANGE OF HEAVY LIQUID WEIR RADIUS AND DENSITY RATIO(K) (THROTTLE DEVICE ON NOZZLE SEPARATOR MODEL ODB 260)

($K=P_{LP}/P_{HP}$)

| $K, r_{LP}$=CONSTANT | | | | $r_{LP}, r_E$=CONSTANT | | | |
|---|---|---|---|---|---|---|---|
| K | LIGHT FL WEIR RADIUS | HEAVY FL WEIR RADIUS | SEPARATION LINE RADIUS | K | LIGHT FL WEIR RADIUS | HEAVY FL WEIR RADIUS | SEPARATION LINE RADIUS |
| | $r_{LP}$ mm | $r_{HP}$ mm | $r_E$ mm | | $r_{LP}$ mm | $r_{HP}$ mm | $r_E$ mm |
| 0,900 | 110,0 | 149,0 | 336 | 0,913 | 110,0 | 149,0 | 358 |
| 0,900 | 110,0 | 154,0 | 358 | 0,900 | 110,0 | 154,0 | 358 |
| 0,900 | 110,0 | 159,0 | 380 | 0,887 | 110,0 | 159,0 | 358 |

FIG. 5a'''

CHANGE OF LIGHT LIQUID
WEIR RADIUS AND DENSITY RATIO (K)
(STRIPPING DISK ON NOZZLE SEPARATOR MODEL ODB260)

$K=P_{LP}/P_{HP}$ $P_{LP}$=870 KG/M²:N-2800RPM

| K | LIGHT FL WEIR RADIUS | | "EXTRA" PRESSURE LOSS STRIPPING DISK | HEAVY FL WEIR RADIUS | SEPARATION LINE RADIUS | K | LIGHT FL WEIR RADIUS | | "EXTRA" PRESSURE LOSS STRIPPING DISK | HEAVY FL WEIR RADIUS | SEPARATION LINE RADIUS |
|---|---|---|---|---|---|---|---|---|---|---|---|
| | $r_{LP}$ mm | $r^*_{LP}$ mm | $\Delta P_{SS}$ Pa | $r_{HP}$ mm | $r_E$ mm | | $r_{LP}$ mm | $r^*_{LP}$ mm | $\Delta P_{SS}$ Pa | $r_{HP}$ mm | $r_E$ mm |
| 0,900 | 110,0 | 110,0 | 0 | 154,0 | 358 | 0,900 | 110,0 | 110,0 | 0 | 154,0 | 358 |
| 0,900 | 110,0 | 103,7 | 50,000 | 154,0 | 375 | 0,890 | 110,0 | 103,7 | 50,000 | 154,0 | 358 |
| 0,900 | 110,0 | 97,1 | 100,000 | 154,0 | 390 | 0,880 | 110,0 | 97,1 | 100,000 | 154,0 | 358 |

FIG. 5b

CHANGE OF LIGHT AND HEAVY LIQUID
WEIR RADIUS AND DENSITY RATIO (K)
(STRIPPING DISK AND THROTTLE DEVICE ON NOZZLE SEPARATOR MODEL ODB260)

$K=P_{LP}/P_{HP}$ $P_{LP}$=870 KG/M$^2$:N-2800RPM

| K | LIGHT FL WEIR RADIUS | | "EXTRA" PRESSURE LOSS STRIPPING DISK | HEAVY FL WEIR RADIUS | SEPARATION LINE RADIUS | K | LIGHT FL WEIR RADIUS | | "EXTRA" PRESSURE LOSS STRIPPING DISK | HEAVY FL WEIR RADIUS | SEPARATION LINE RADIUS |
|---|---|---|---|---|---|---|---|---|---|---|---|
| | $r_{LP}$ mm | $r^*_{LP}$ mm | $\Delta P_{SS}$ Pa | $r_{HP}$ mm | $r_E$ mm | | $r_{LP}$ mm | $r^*_{LP}$ mm | $\Delta P_{SS}$ Pa | $r_{HP}$ mm | $r_E$ mm |
| 0,900 | 110,0 | 110,0 | 0 | 149,0 | 336 | 0,913 | 110,0 | 110,0 | 0 | 149,0 | 358 |
| 0,900 | 110,0 | 103,7 | 50,000 | 154,0 | 375 | 0,890 | 110,0 | 103,7 | 50,000 | 154,0 | 358 |
| 0,900 | 110,0 | 97,1 | 100,000 | 159,0 | 410 | 0,867 | 110,0 | 97,1 | 100,000 | 159,0 | 358 |

FIG. 5c

SEPARATOR HAVING A LIQUID OUTLET INCLUDING A THROTTLING DEVICE

BACKGROUND

The present disclosure relates to a separator having an at least inwardly singly or doubly conical separator drum which is mounted rotatably at only one of its axial ends and which has a vertical axis of rotation. The present disclosure also relates to a method for three-phase separation by a separator of this type.

Separators of this type are known. As a rule, liquid discharges or outlets are provided with what are known as stripping disks which utilize the effect whereby the rotational energy of the inflowing liquid is converted to a dynamic pressure in the outflow line. Stripping disks of this type have proved appropriate. In particular, it is possible by throttling to vary the prevailing dynamic pressure and consequently to vary the separation zone in the drum or the radius of the separation zone in the drum over a certain range A. It is also known, in particular, to assign stripping disks to both liquid outlets.

A known three-phase separator is illustrated in FIG. 3. If a stripping disk is assigned to one or both of the two liquid outlets from the drum and the further outlet is of nozzle-like design, this results in a range delta LP, within which the stripping disk, by throttling, allows a displacement of the separation zone in the drum (see, for example, WO 86/01436). Here, on the one hand, the range of displaceability of the separation zone is still relatively low, and it is also not readily possible, via the stripping disks, to displace the separation zone sufficiently quickly during operation. Displacement also does not always lead to stable process conditions, since the variation in the throttling of the stripping disk sequences at the same time influences a plurality of parameters of the process.

By contrast, the present disclosure relates to the development of a separator in such a way that a displacement of the separation zone within the drum over a greater radial range is possible in a simple way during operation, while an improved settability of the position of the separation zone is to be possible. Furthermore, the present disclosure also relates to a method for operating a separator of this type.

The present disclosure relates to a separator with an at least inwardly singly or doubly conical separator drum which is mounted rotatably at only one of its axial ends and which has a vertical axis of rotation. The separator also includes: only at its lower end or at its upper end, a rotary spindle for driving the separator drum, which rotary spindle is mounted oscillatingly about an articulation point; an inflow pipe for a product to be processed at least two liquid outlets for a lighter phase and a heavier phase, the liquid outlet for the lighter phase being provided with a stripping disk; solid discharge ports, preferably in the region of its largest inner circumference; a separation plate stack arranged in the separator drum; and the further of the liquid outlets, or the liquid outlet for the heavier phase, being followed outside the drum by a settable throttle device which has an annular or throttle disk and is designed for displacing the liquid radius, up to which the heavy phase extends in the drum, by a variation in the outflow cross section for the heavy liquid phase, that is to say by throttling.

In accordance with the present disclosure, an improved controllability of the process is obtained. In particular, that is an improved regulatability of the position of the separation zone, also called the E-line.

It is also possible to compensate for changes both of the product quantities (phase relation) and of the product characteristic (in particular, density) and nevertheless to keep the separation line virtually constant. Nozzle wear can be determined and the service lives prolonged.

Throttle devices of the type of annular disks which do not rotate during operation are known from the sector of solid-jacket worm centrifuges, i.e., from DE 102 09 925 A1 or DE 102 03 652 A1. Nevertheless, the drums of these centrifuges are mounted in the region of both axial ends and not oscillatingly, like centrifuges. This results in the difference that the drums of the decanters or solid-jacket worm centrifuges rotate about a defined axis, whereas separator drums execute a certain precessional movement. It was therefore assumed that the conditions at the annular outflow gap are not sufficiently constant to achieve a defined setting of the separation zone between the light and the heavy phase and a displacement of the outflow radius of the heavy liquid phase with the aid of an adjustable throttle disk. This presumption, however, has not been confirmed. Contrary to expectations, stable conditions are established, even at the outflow gap of the separator, on the throttle disk. Instead, the throttle disk improves process efficiency and the fine tuning and stability of the process.

The separator is suitable for the most diverse possible three-phase separation tasks, in particular for crude oil treatment, in which the crude oil is clarified of solids and water is separated from the crude oil.

The present disclosure also provides a use of a separator for crude oil treatment, in which the crude oil is clarified of solids and water is separated from the crude oil.

The present disclosure moreover, provides a method for the three-phase separation and clarification of a product to be processed into at least two liquid phases and one solid phase. The processing of the product takes place in a separator, according to the present disclosure. A product to be processed is provided and fed into the separator. The separator is operated and, to set the separation zone, a setting of the radius of the lighter liquid phase LP by the stripping disk occurs and a setting of the heavier liquid phase occurs HP and, consequently of the separation zone, occurs by the throttle device, i.e., the annular disk. The setting of the separation zone takes place once during the separator operation.

Other aspects of the present disclosure will become apparent from the following descriptions when considered in conjunction with the accompanying drawings.

BRIEF DESCRIPTION OF THE DRAWINGS

FIGS. 5*a*'; 5*a*", 5*a*'", 5*b* and 5*c* are tables illustrating the effects of the separators, according to the present disclosure.

DETAILED DESCRIPTION

Figure 1:
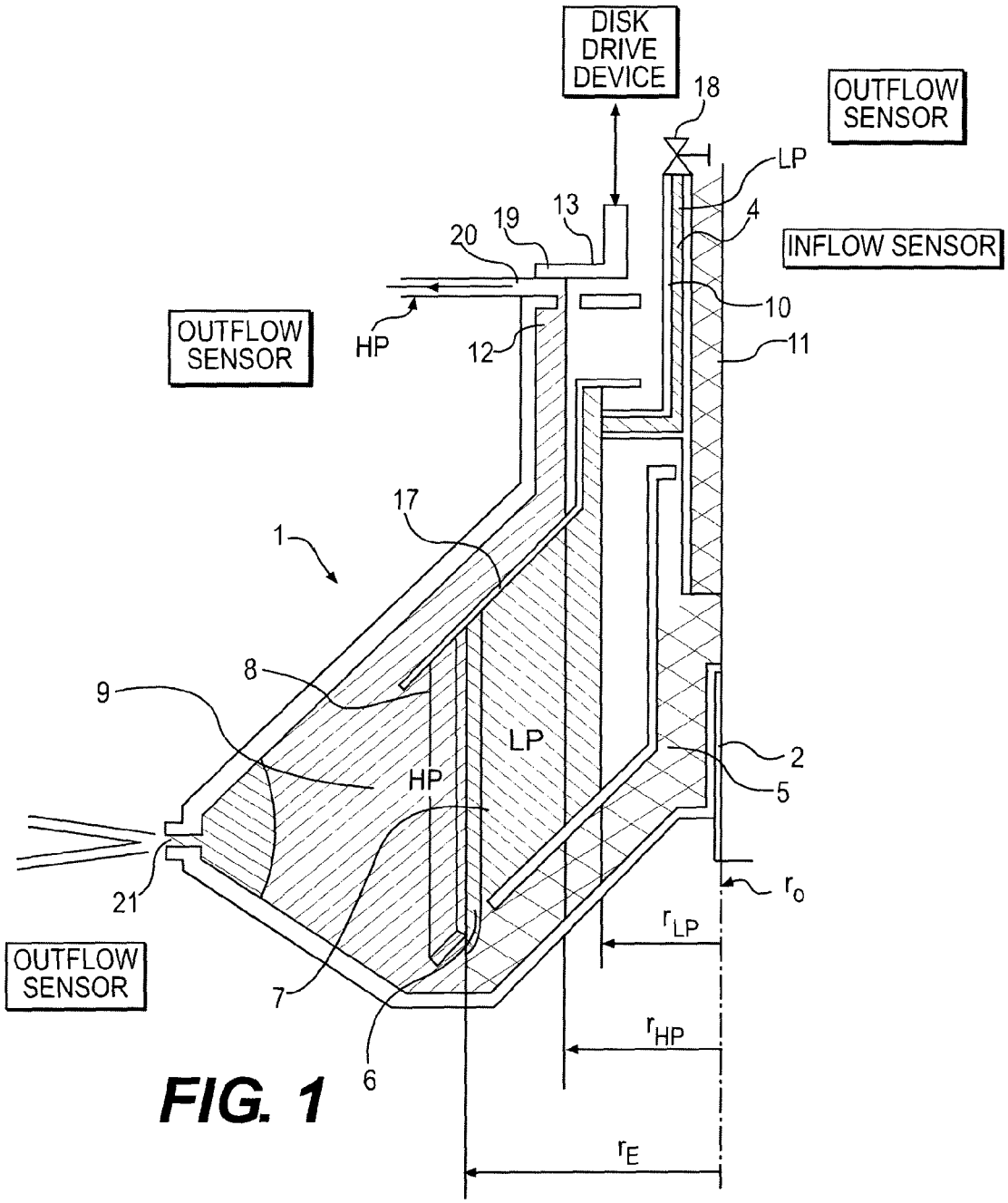
FIG. 1 is a sectional view through one half of an embodiment of a separator drum, according to the present disclosure.
Figure 2:
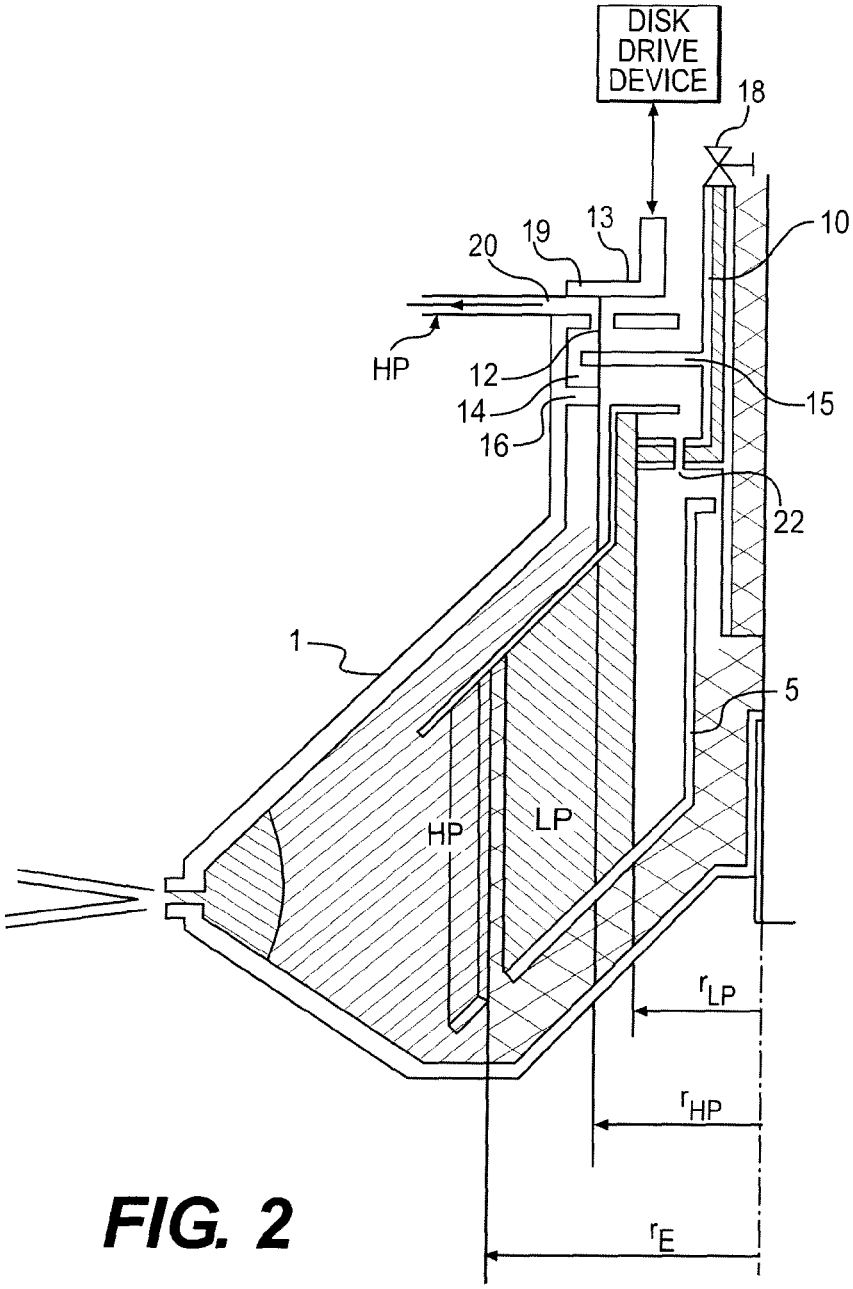
FIG. 2 is a sectional view through another embodiment of a separator drum, according to the present disclosure.
Figure 3:
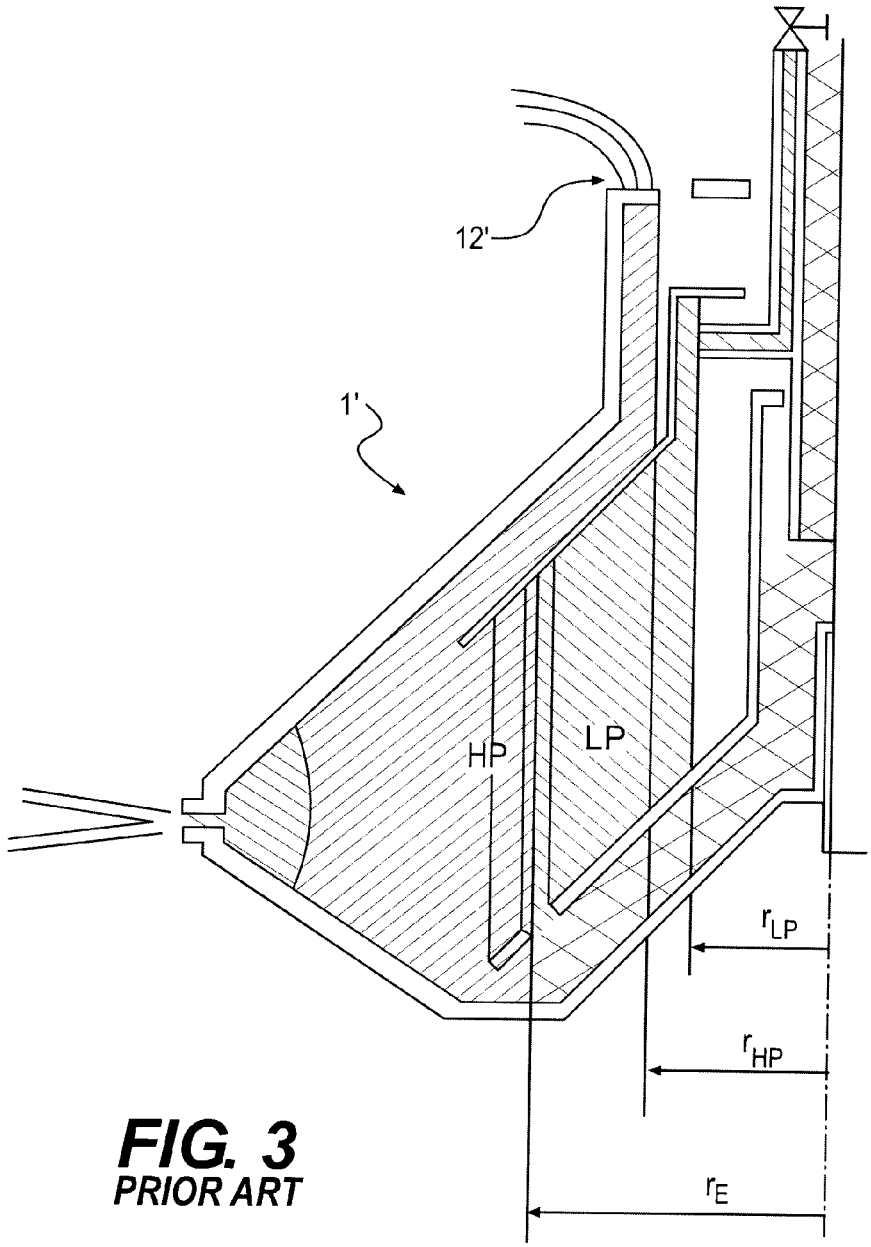
FIG. 3 PRIOR ART
FIG. 3 shows a separator drum, according to the prior art.

FIGS. 1 and 2 show separator drums 1 which have a vertically oriented axis of rotation at radius $r_0$, according to the present disclosure. FIG. 3 shows a separator drum 1' of the prior art.

Figure 4:
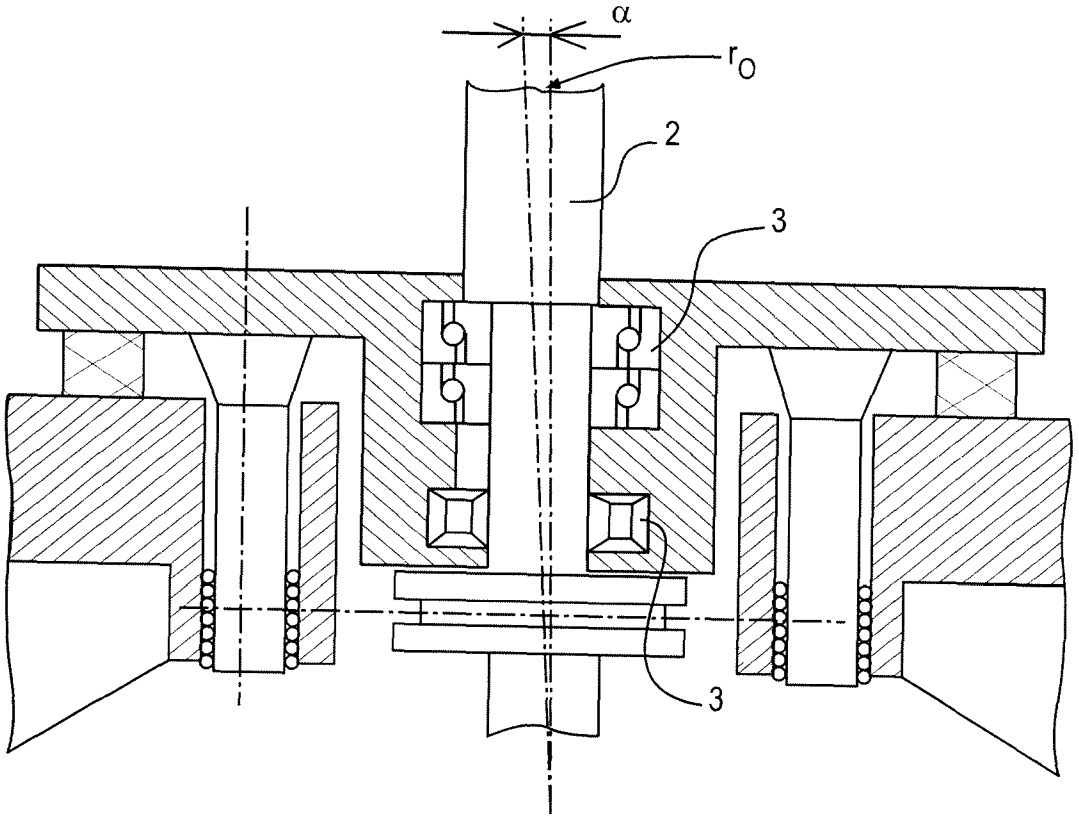
FIG. 4 is a sectional view through a drive region of the separator drums of FIGS. 1 and 2.

The separator drums 1 are placed onto a rotary spindle 2 which, for example, according to FIG. 4, is driven (not illustrated here) directly or via a belt or in another way, for example, a gear. The rotary spindle 2 may be configured conically in its upper circumferential region.

The rotary spindle 2 is mounted oscillatingly by at least one or more rolling bearings 3 on one side of the drum 1, shown in FIG. 4 beneath the drum. Therefore, during operation, because of residual unbalances, and contrary to what happens in a decanter, a new axis occurs which executes a type of precessional movement about the vertical axis $r_0$, as suggested in FIG. 4 where the inclination angle $\alpha$ is illustrated.

Designs are known in which a lower drum is virtually "suspended" on an upper rotary spindle. Here, too, however, the drum is rotatably mounted oscillatingly at only one of its ends or adjacently to one of its axial ends.

The separator drum 1 has an inflow pipe 4 for a product P to be centrifuged. Pipe 4 is followed by a distributor 5 which is provided with at least one or more outflow ports 6 through which inflowing centrifuging product, e.g., see the cross hatching, can be conducted into the interior of the separator drum 1, as shown in FIG. 1. Also shown is a riser channel 7 of a plate stack 8. It is conceivable that a feed of product through the spindle 2, for example, from below may be envisaged.

In the present disclosure, the embodiments shown are such that the outflow ports 6 lie beneath the riser channel 7 in the plate stack 8, for example, at an outside diameter at the location of reference symbol 8. Plate stack 8 includes conically shaped separation plates 9. The plate stack 8 is closed off upwardly by a partition plate 17 which has a larger diameter than the plate stack 8.

Within the separation plate stack 8 and, for example, within the riser channel 7, a separation zone between a lighter liquid phase LP, i.e., the cross-hatching from bottom right to top left and a heavier liquid phase HP, i.e., the cross-hatching from bottom left to upper right is formed during operation. This occurs in the case of a corresponding rotation of the drum 1, at a specific radius, $r_E$, the emulsion line or separation line and also called the E-line.

The lighter liquid phase LP (light phase) is conducted out of the drum at an inner radius $r_{LP}$ with the aid of a stripping disk 10, also called a gripper. With the aid of the dynamic pressure occurring as a result of the rotational energy of the liquid, the stripping disk 10 acts in the same way as a pump. The stripping disk 10 is followed, for example, outside the separator, in its following discharge line by a valve 18 for throttling.

By contrast, the heavy liquid phase HP flows around the outer circumference of the partition plate 17 to a liquid outlet 12 at the upper axial end of the drum 1 at radius $r_{HP}$.

The designs shown in FIGS. 1 and 2, to the extent just described, correspond to one another. They may also be provided with the same drive devices.

According to FIG. 3, the heavy phase HP flows out of the drum 1 in the manner of an overflow at the liquid outlet 12'.

By contrast, the designs according to the present disclosure, as shown in FIGS. 1 and 2, contrary to the design of FIG. 3, are provided in the region of the liquid outlet 12 with a settable throttle device 13, with the aid of which the cross section at the liquid outflow 12 is variable.

In order to implement throttle device 13 in a simple way in structural terms, it is proposed, according to FIGS. 1 and 2, to arrange in the axial direction above the liquid outlet 12, outside the drum 1, a type of annular or throttle disk 19. Throttle disk 19 which is arranged and designed so as to be spaced apart from the at least one liquid outflow port, for example, liquid outlet 12, the position of the annular disk 19 in relation to the at least one outflow port being variable. The disk 19 may have a planar surface or, for example, be provided with grooves. The surface of the annular disk 19 may be oriented perpendicularly to the drum axis.

The annular disk 19 may be arranged, for example, axially displaceably or pivotably at one of its circumferential edges. The annular disk 19 is assigned a drive which is designed for varying the distance between the annular disk 19, which may be stationary during operation, and the outflow port 12.

The annular disk 19 may be designed to be stationary during operation and does not co-rotate with the drum 1.

Between the annular disk 19 and the outflow ports 12, a gap 20 is formed, through which the heavy liquid phase HP flowing out of the drum 1 flows. A width of the liquid gap 20 is variable.

The radius of the E-line within the drum 1 can be displaced over a certain range. This may be done both by the throttling of the stripping disk 10 and by the adjustment of the throttle device 19 or, of the gap width of the gap 20 by the movement of the annular disk 19.

Here, the doubly conical drum 1 has, in the region of its largest diameter, solid outflow nozzles 21 which serve for the continuous discharge of solid particles S from the drum 1. This configuration may be preferred. Embodiments without an additional solid discharge may, however, likewise be envisaged.

The original presumption, that, when a moveable annular disk 19 is used, sufficiently stable conditions at the outflow gap 20 are not established on a drum mounted on only one side or in an overhung manner, on account of the marked precessional movement, since the gap 20 does not have a constant gap width because of the precessional movement, has not proved to be true. See the tables of FIGS. 5*a'*, 5*a''*, 5*a'''*, 5*b* and 5*c*.

On the contrary, the displaceable annular disk 19 leads to a marked improvement in the settability of the emulsion line, or E-line, and to a better manageability and controllability of the process. An enlarged setting range of the separation zone is also obtained.

Thus, as mentioned above, the designs of FIGS. 1 and 2 are essentially identical to one another.

The outflow ports 12 may have a round shape in the manner of bores or else, for example, widen in a wedge-like or step-like manner from the inside outwardly, thus increasing the regulatability in various instances. A small tube could also be inserted into the outflow ports (not shown). An advantage of this being that the liquid stream does not come to lie on the drum 1.

As shown in FIG. 2, the liquid outflow 12 is preceded by a type of hydrohermetic annular chamber 14.

This includes a disk 15 which precedes the liquid outflow 12 within the drum 1 and which extends outward from the outer circumference of the stripping disk 10. Disk 15 has a maximum circumferential radius which is greater than a maximum radius up to which the outflow ports 12 extend. The stationary nonrotating or closing disk 15 is preceded within the drum 1 by a type of annular disk 16 as a first weir which extends inwardly from the inner circumference of a drum cover of the drum 1. The inner radius of disk 16 is smaller than the maximum radius up to which the disk 15 and the outflow ports 12 extend, so that the hydrohermetic annular chamber 14 is formed, as a second weir, on the inner circumference of the drum cover of the drum 1 in the region between the annular disk 16 and the outflow ports 12.

This chamber 14 prevents the uncontrolled outflow of gasses or vapor from the drum 1 through the outflow ports 12 or labyrinths or other gaps or the like, which will result in a brief instability in the region of the emulsion line, or E-line or separation zone.

For pressure compensation, vertical bores 22, which extend through the disk-shaped extension of the stripping disk 10 and are not operatively connected to the outflow duct in the stripping disk, may be provided.

In practice, the embodiments of the present disclosure have the following effect.

Improved control or settablity of the radius $r_E$ of the emulsion line or E-line, also called, as noted above, the separation zone or separation line. This significantly increases the optimizability, stability and fine tuning of the process in the three-phase separation system.

If it is assumed that the throttle device 13, by an adjustable throttle disk 19, can adjust the discharge radius of the heavy liquid phase HP by the amount of 10 mm and that the stripping disk 10 can exert an additional pressure drop of 100 000 Pa, this forms the possibility of setting the E-line or of maintaining a stable E-line with different density rates (K). See the tables of FIGS. 5*a'*, 5*a''*, 5*a'''*, 5*b* and 5*c*.

The throttle device 13 alone can achieve an adjustability of the discharge radius of the heavy liquid phase HP of approximately 336 to 384 mm, that is to say, 48 mm, or a compensation of a density ratio variance (K) of 0.884 to 0.915 (0.031). That occurs since, either by a reaction to displacements or else in the case of product changes, as a result of a variation in the gap width of the gap 20 a displacement of the separation zone is counteracted, in order to keep this at as constant a radius as possible, so as to keep the process stable.

By contrast, the stripping disk 10 alone can achieve an adjustment of the radius of the separation line of 360 to 392 mm, i.e., 32 mm, or a compensation of the density change or density ratio variance (K) of 0.878 to 0.900, i.e., 0.022.

In combination, the throttle device 13 and the stripping disk 10 can achieve an adjustability of the separation zone or of the radius of the E-line of 336 to 414 mm, i.e., corresponding to 78 mm, or a density ratio variance (K) of 0.863 to 0.915, i.e., 0.052.

This shows, impressively, that, with the combination of the stripping disk 10 the throttle device 13 and the solid discharge nozzles 21, which nozzles 21 are followed by a discharge system, for example, with guide plates or the like, it is not only possible to adjust the E-line over a wide range, but it is also possible to keep the E-line constant in a particularly simple way. This is so, for example, when the composition or property of the centrifuging product changes or, due to nozzle wear, the machine properties change, for example, the discharge cross section for the solid phase and consequently the outflow quantity of the solid phase.

If, as shown in FIG. 2, a hydrohermetic chamber 14 is provided, it is possible to prevent vapor or gas, for example, hydrocarbons and/or water or oil vapor, from escaping from the liquid, specifically independently of the process temperatures. This affords the advantage that neither separation or separation efficiency in the plate stacks 8 nor the position of the E-line radius are influenced by water vapor.

It is also possible to provide a separate and independent water supply into the drum 1 (not shown) but implementable, for example, by a concentric feed pipe within the feed pipe 4 for the product and, further on, through the distributor 5 into the drum 1, in order during a three-phase separation, without an additional hydraulic load being exerted on the plate stack 8, to ensure that a sufficient dynamic pressure always prevails at the gap 20. If, however, there were not a complete flow through the gap 20, an uncontrolled displacement of the E-line would possibly occur.

The discharge volume flow through the gap 20 is preferably observed and, if appropriate, also measured, in order to prevent dry runs of this type and in order, as far as possible, to minimize the volume of the water to be added.

In accordance with the present disclosure, it is also possible and advantageous to measure the flow quantity of the product to the centrifuge in exactly the same way as the flow quantities at the outflows via the stripping disk 10 and through the gap 20 at the throttle device 13. The discharge rate of solids through the solid discharge nozzles 21 is determinable from the differences between these variables.

The nozzle discharge capacity can initially be determined theoretically on the basis of the machine design and of the rotational speed of the drum 1. This capacity is designated below as the "nominal" capacity or discharge rate.

The difference between the nominal and the "measured" discharge rates of the solid nozzles reproduces information on the operating states of the nozzles 21.

If the "measured" discharge rate is higher than the nominal rate, the nozzles 21 exhibit wear and a period of time may be indicated, within which it is recommended to repair or maintain the solid discharge nozzles 21. This is advantageous, since it is possible to maximize the time up to the changing of the nozzles 21.

If the measured "discharge rate" is lower than the nominal rate, it can be concluded from this that one or more of the solid discharge nozzles 21 are blocked.

The system, according to the present disclosure, may be designed for carrying out an automatic correction of the effect of nozzle wear, when it is established whether the solid discharge nozzles 21 are blocked or not.

Finally, it is also possible to set up a type of expert system for process optimization and regulation with the aid of the separator drum 1, according to the present disclosure.

The pressure drop across the throttle device 13 at the gap 20 depends on the throughflow rate or throughflow quantity and on the size of the gap 20. The pressure drop across the stripping disk 10 depends on the throughflow quantity and on the throttling pressure at the valve 18 of the stripping disk 10. The pressure drops influence the outflow quantities of the heavy HP and the light LP phases. In combination, and in each case considered separately, moreover, the outflow line radii influence the position of the E-line.

Since it is clear how the heavy $r_{HP}$ and light $r_{LP}$ outflow radii are influenced by the pressure drop at the gap 20 and at the stripping disk 10 and how this influences the E-lines, an improved control and regulation system can be provided for the separator.

Thus, from the fact that the radius of the E-line is particularly small, the user can conclude that a higher fraction of heavy phase HP is present in the light phase LP, and vice versa.

If the emulsion is not separable, an emulsion layer has built up within the centrifuge.

Since suitable variations in the settings at the gap 20 and/or at the stripping disk 10 are carried out, it is possible either to prevent the occurrence of the emulsion layer or to discharge this into the heavy HP or the light LP liquid discharge, before the process becomes unstable or poorer clarification takes place or before the process becomes uncontrollable.

By an online expert system, a stable separation process can be maintained, even though a fluctuation in the product supply rate and product composition may occur or a density fluctuation of the heavy HP and/or the lighter liquid phase LP. Such effects arise, for example, in the case of natural products, such as fish oil, or else in crude oil treatment, i.e., separation of water from the crude oil, or in water treatment, i.e., separation of oil residues from the water.

Since the online expert system is supplemented by an online measurement of the throughflow quantity and/or of the product flow quantity, it is possible to calculate the supply density or, finally, to measure the density directly.

A correction of the flow quantity of the solids can be carried out in that the solid content is measured, since the solid density constitutes a relatively constant parameter.

By the discharge flow quantity of light phase LP and the flow quantity being measured, the light phase density and, finally, the density can be measured directly.

The inflow quantity and the outflow quantity of the heavy HP and the light phase LP can be determined from the densities.

From all these values, conclusions can be drawn which make it possible to optimize the separation process by settings at the gap 20 alone and/or by the suitable throttling of the stripping disk 10.

This simple expert system may be supplemented by an online measurement of the exact heavy phase HP composition and of the light phase LP composition. Neither the heavy phase HP nor the light phase LP typically possess a polarity which would make the measurement of the volumetric concentration simple.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A separator comprising:

at least one of a singly and doubly conical separator drum mounted rotatably at only one of the drum's axial ends and the drum having a vertical axis of rotation;

a rotary spindle, located only at one of the drum's lower and upper ends, is provided to drive the separator drum, the rotary spindle being mounted oscillatingly;

an inflow pipe for a product to be processed;

at least two liquid outlets, a first liquid outlet for a lighter liquid phase and a second liquid outlet for a heavier liquid phase, the first liquid outlet including a stripping disk;

a solids discharge port located in a region of the separator's largest inner circumference;

a separation plate in the separator drum; and the second liquid outlet being followed outside the drum by a settable throttle device having an annular disk for displacing a liquid radius of the heavier liquid phase, up to which radius the heavier phase extends in the drum, by a throttling in an outflow cross section for the heavier liquid phase.

2. The separator as claimed in claim 1, wherein the annular disk is arranged in an axial direction above the first liquid outlet outside the drum.

3. The separator as claimed in claim 1, wherein the annular disk is assigned a drive device and the annular disk is arranged axially moveably so that a distance between the annular disk, which is stationary during operation, and the second liquid outlet is variable.

4. The separator as claimed in claim 3, wherein the annular disk is moveable pivotably and the distance is a gap width of an annular gap.

5. The separator as claimed in claim 1, wherein the annular disk is nonrotating during operation.

6. The separator as claimed in claim 1, wherein the solid outflow port is a nozzle for the continuous discharge of solid particles from the drum.

7. The separator as claimed in claim 1, further including at least one or more sensors for measuring product flow rates at one or both of the inflows and outflows to and from the separator.

8. The separator as claimed in claim 1, wherein the second liquid outlet and the throttle device are preceded by a hydrohermetic annular chamber.

9. The separator as claimed in claim 8, wherein the hydrohermetic annular chamber includes a retaining disk which precedes the second liquid outlet within the drum and which extends outwardly from an outer circumference of the stripping disk and which has a maximum circumferential radius which is larger than a maximum radius up to which the second liquid outlet extends, the retaining disk being preceded by an annular disk which extends inwardly from an inner circumference of a drum cover of the drum and an inner radius of which is smaller than the maximum radius up to which the retaining disk and the second liquid outlet extend, so that the hydrohermetic annular chamber is formed on the inner circumference of the drum cover of the drum in a region between the annular disk and the second liquid outlet outflow port.

10. A method for a three-phase separation and clarification of a product to be processed into at least two liquid phases and one solid phase, the method steps comprising:

providing a separator that includes at least one of a singly and doubly conical separator drum mounted rotatably at only one of the drum's axial ends and the drum having a vertical axis of rotation, a rotary spindle, located only at one of the drum's lower and upper ends, is provided to drive the separator drum, the rotary spindle being mounted oscillatingly, an inflow pipe for a product to be processed, at least two liquid outlets, a first liquid outlet for a lighter liquid phase and a second liquid outlet for a heavier liquid phase, the first liquid outlet including a stripping disk, a solids discharge port located in a region of the separator's largest inner circumference, a separation plate in the separator drum, and the second liquid outlet being followed outside the drum by a settable throttle device having an annular disk for displacing a liquid radius of the heavier liquid phase, up to which radius the heavier phase extends in the drum, by a throttling in an outflow cross section for the heavier liquid phase;

providing a product to be processed;

feeding the product into the separator;

operating the separator;

setting a separation zone by setting a radius of the lighter liquid phase via the stripping disk and setting a radius of the heavier liquid phase via the throttle device; and the setting of the separation zone taking place once during the separator operation.

11. The method as claimed in claim 10, wherein the separation zone is kept at a constant radius by regulating as a function of one of an inflow quantity of product feed and the product characteristics.

12. The method of claim 10, further including the step of determining the inflow quantity of the product to be fed into the drum and a product discharge out of the drum, the determination being made at the stripping disk and the throttle device, and further determining a flow quantity of solids from a difference between the determined inflow quantity and the product discharge.

13. The method of claim 12, further including the step of determining a variation in the state of the solid discharge port by a variation in the determined flow quantity of the solids, wherein an increase in the flow quantity pointing to a wear of the nozzle and a decrease in the flow quantity pointing to a blockage or contamination of the nozzle.

14. The method as claimed in claim 13, wherein, in the event of a formation of an emulsion, the separation zone is displaced as a result of the adjustment of the stripping disk and of the throttle device in such a way that the emulsion is discharged through the stripping disk or a gap at the throttle device.

15. The method as claimed in claim 10, further including the step of measuring a solid content of the product fed into the separator drum.

16. The method as claimed in claim 10, further including the step of measuring an outflow volume of the light liquid phase.

17. The method of claim 10, wherein the product to be processed is crude oil and the crude oil is clarified of solids and water is separated from the crude oil.

* * * * *